US005251902A

United States Patent [19]

Federowicz et al.

[11] Patent Number: 5,251,902

[45] Date of Patent: Oct. 12, 1993

[54] GOLFER'S HEAD ROTATION INDICATING MEANS AND METHOD

[76] Inventors: John Federowicz, 568 Browns Rd., Storrs, Conn. 06268; James E. Obenauf, 8457 E. Desert Steppes; Thomas W. McCurnin, 8451 E. Desert Steppes, both of Tucson, Ariz. 85710

[21] Appl. No.: 853,413

[22] Filed: Mar. 16, 1992

[51] Int. Cl.[5] ..... A63B 69/36

[52] U.S. Cl. ..... 273/187.2; 273/190 A

[58] Field of Search ..... 273/183 B, 187.2, 190 R, 273/190 A, 190 B; 434/252

[56] References Cited

U.S. PATENT DOCUMENTS

| | | | |
|---|---|---|---|
| 4,392,830 | 7/1983 | Salzman et al. | 434/258 |
| 4,502,035 | 2/1985 | Obenauf et al. | 340/323 B |
| 4,869,509 | 9/1989 | Lee | 273/183 B |
| 5,108,104 | 4/1992 | Johnson | 273/183 B |

*Primary Examiner*—George J. Marlo
*Attorney, Agent, or Firm*—John H. Crozier

[57] ABSTRACT

In a preferred embodiment, a device for indicating rotation of the head of a golfer during the process of hitting a golfball, which includes: a housing; a sensor including a pendulum switch disposed in the housing to sense the beginning of rotation of the head from an initial position, generally about the axis of the spine of the golfer, and to produce an output signal thereupon; a sound producing device activatable in response to the output signal to provide an audible signal to the golfer; an adjustment device to adjust the sensor so that the sensor will not produce the output signal when the head is in a desired position, but will produce the output signal when the head begins to rotate in the direction the golfball will be hit; and a manually initiated timing device to which the sensor is responsive to permit the sensor to produce the output signal only during a selected period of time after manual initiation of the timing device.

8 Claims, 4 Drawing Sheets

GOLFER'S HEAD ROTATION INDICATING MEANS AND METHOD

BACKGROUND OF THE INVENTION

1. Field of the Invention

The present invention relates to the sport of golf generally and, more particularly, but not by way of limitation, to a novel means and method to aid a golfer in determining whether or not the timing of the rotation of the golfer's head relative to striking the golfball is proper.

2. Background Art

The most common problem facing the golfer is the rotation of the golfer's head during the golf swing. The advice to golfers to "keep your eye on the ball" is well known. This advice is directed to the requirement that the golfer keep the golfer's eyes straight ahead with the golfer's head orientated toward the golfball as the swing of the club commences and until the golfball is struck. Ideally, when the golfball is struck, the head begins to rotate, generally around the axis of the spine, in the direction of the swing with the eyes not moving relative to the head, but still fixed on the golfball or at least on the head of the club.

Unfortunately, it is a common reaction of most golfers to rotate the head in the direction in which the golfball will be hit before the golfball is struck, even though the golfer is still looking at the golfball. This premature movement affects the entire swing and results in less than desired performance.

Some devices have been developed to assist a golfer by indicating such premature head rotation. None of these has proven to be satisfactory, however. Most are complicated. Some employ a motion sensor mounted on a hat, the sensor including audible sound producing means. While the motion sensor can be accurately placed on the hat, it is very difficult to place the hat on the head in precisely the same orientation each time it is used. Another type of device requires that a head band be precisely positioned on the golfer's head. Most known devices do not permit the convenient energizing and de-energizing of the devices and some continuously emit a sound during movement other than during the golf swing.

Accordingly, it is a principal object of the present invention to provide means and method for indicating to a golfer that the golfer's head is beginning to rotate in the direction the golf golfball will be hit.

It is a further object of the invention to provide such means that can be quickly and accurately placed in operating position.

It is an additional object of the invention to provide such means that can be conveniently energized and that provides an indication only of the commencement of movement of the golfer's head.

It is another object of the invention to provide such means that is armed for only a selected, limited period of time.

It is yet a further object of the invention to provide such means that is rugged and economically constructed.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a device for indicating rotation of the head of a golfer during the process of hitting a golfball, comprising: a housing; sensor means disposed in said housing to sense the beginning of rotation of said head from an initial position, generally about the axis of the spine of said golfer, and to produce an output signal thereupon; sound producing means activatable in response to said output signal to provide an audible signal to said golfer; adjusting means to adjust said sensor means so that said sensor means will not produce said output signal when said head is in a desired position, but will produce said output signal when said head begins to rotate in the direction said golfball will be hit; and manually initiated energizing means to which said sensor means is responsive to permit said sensor means to produce said output signal only during a selected period of time after manual initiation of said energizing means.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, in which.

DETAILED DESCRIPTION OF THE PREFERRED EMBODIMENTS

Figure 1:
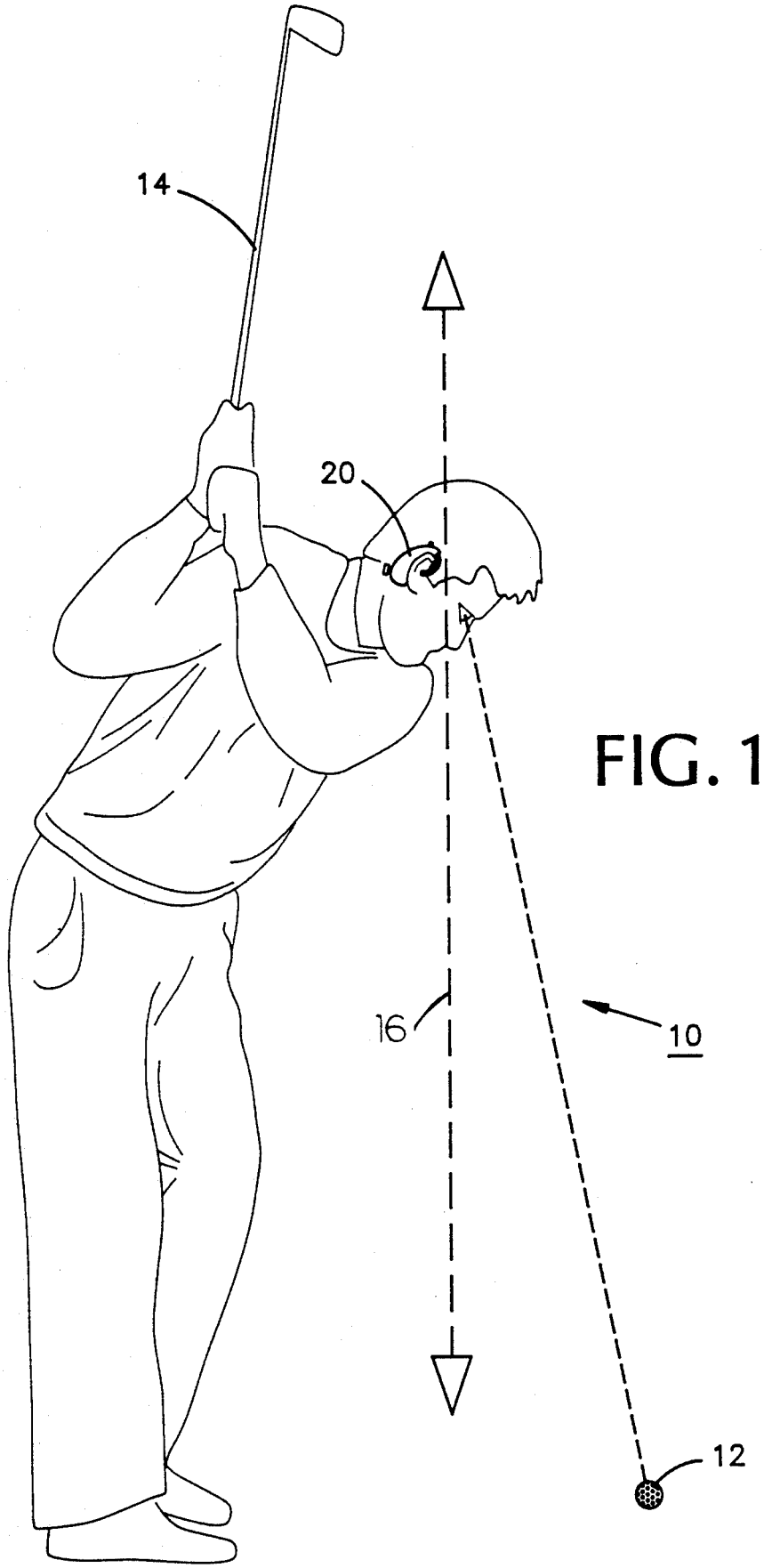
FIG. 1 is a perspective view of a golfer employing a head rotation indicating device accordingly to the present invention.

Reference should now be made to the drawing figures, in which similar or identical elements are given consistent identifying numerals throughout the various figures thereof, and in which parenthetical references to figure numbers direct the reader to the view(s) in which the element(s) being described is (are) best seen, although the element(s) may be seen also in other views.

Referring to FIG. 1, there is depicted a golfer, generally indicated by the reference numeral 10, about to hit a golfball 12 with a golf club 14. Golfer 10 properly is looking directly at golfball 12 and his head is oriented such that it is plumb with respect to the ground as is indicated by the dashed plumb line 16. Golfer is wearing, disposed on his ear, a head rotation indicator according to the present invention, generally indicated by the reference numeral 20.

Reference now also to FIGS. 2–5 will aid in understanding the construction of device 20.

Figure 2:
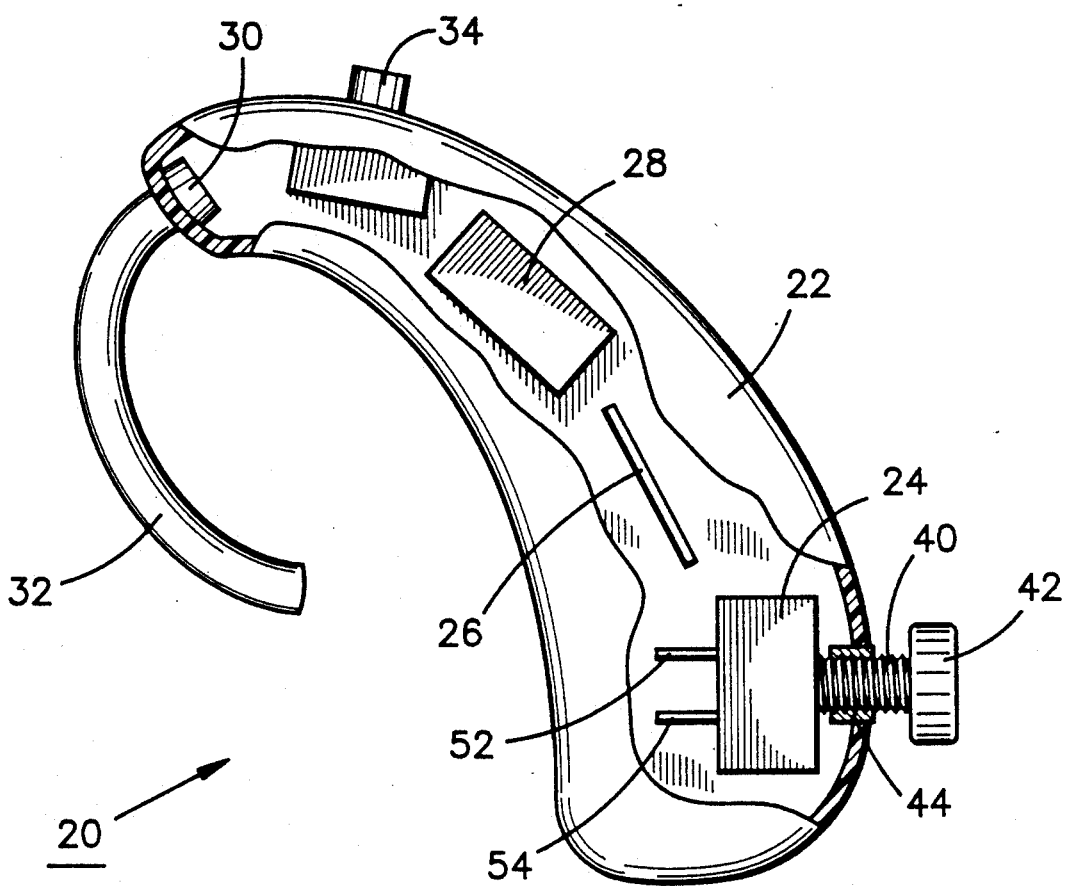
FIG. 2 is an enlarged side elevational view, partially cut away, of the device of FIG. 1.

As seen on FIG. 2, device 20 includes a housing 22 designed to fit comfortably over the ear of golfer 10 (FIG. 1). Disposed within housing 22 are a sensor 24, a printed circuit board 26 containing electrical circuitry, a battery 28, and a speaker 30. Speaker 30 is operatively connected to a sound tube 32 which directs sound from the speaker to the ear of golfer 10 (FIG. 1). A reset button 34 extends through housing 22. Sensor 24 has fixedly attached thereto a threaded adjusting shaft 40 and, at the distal end of the adjusting shaft, is a knob to permit manual rotation of the shaft and the sensor. Shaft 40 extends through a threaded bushing 44 and is snugly fitted therein so that sensor 24 can be maintained at a selected rotational position.

Figure 3:
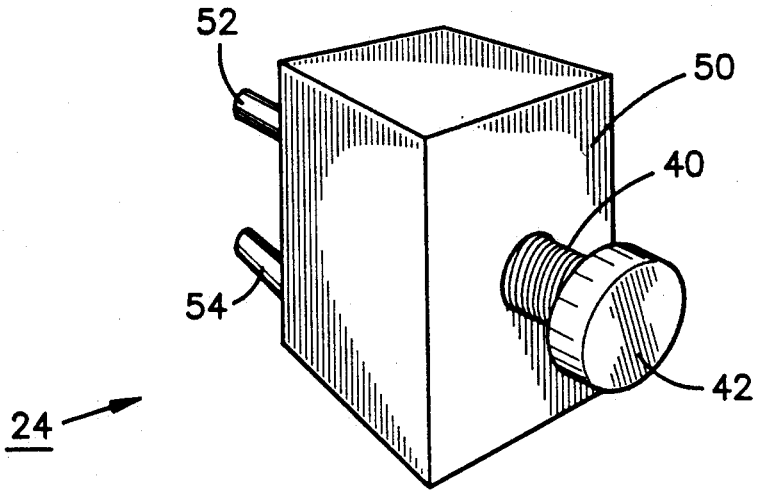
FIGS. 3, 4, and 5 are enlarged perspective, cross-sectional side elevational, and cross-sectional plan views, respectively, of the sensor of the device of FIG. 1.
Figure 4:
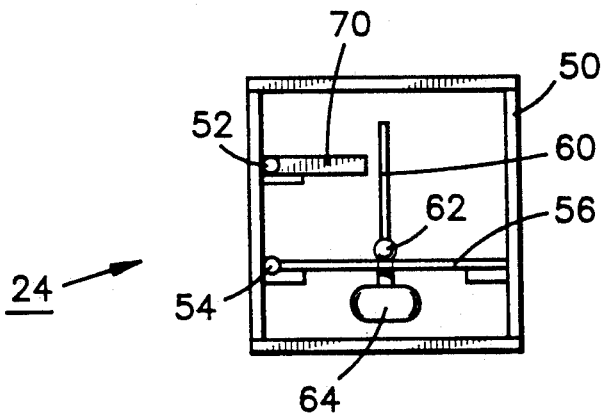
Figure 5:
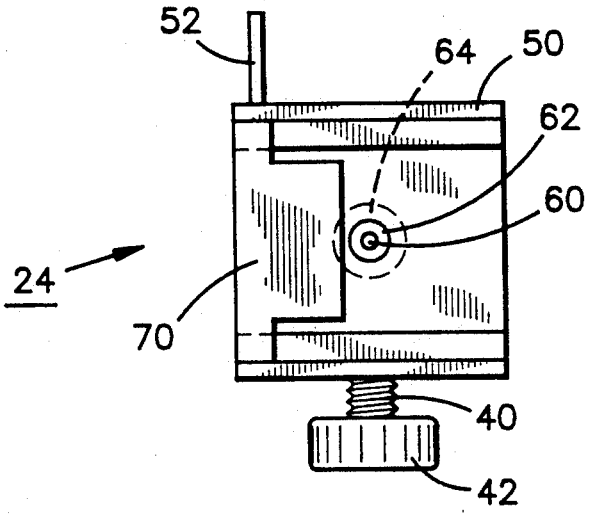

FIGS. 3–5 illustrate further the construction of sensor 24. Sensor 24 includes a housing 50 from which extend leads 52 and 54. Internally of housing 50 is disposed a horizontal base 56 which is in electrical engagement with lead 54. Extending loosely through, and orthogonally from, base 56 is a rigid, vertical contact wire 60 which is maintained in vertical relationship with the base by means of a metallic ball 62 fixedly attached to the contact wire above the base. Contact wire 60 is maintained in vertical position by means of a relatively heavy, weight 64 fixedly attached to the lower end of the contact wire below base 56. Weight 64 has sufficient mass with respect to the mass of contact wire 60 that the weight will remain vertical position relative to the earth, regardless of normal movements of sensor 24. Disposed above base 56, and slightly to one side of contact wire 60, is a contact tab 70 which is in electrical engagement with lead 52. It can be seen that, if sensor 24 is rotated about the axis of shaft 40 in a clockwise direction, contact wire 60 will touch contact tab 70 thus completing an electrical circuit between leads 52 and 54, while, if the sensor is rotated in a counterclockwise direction, the electrical circuit will be opened.

Figure 6:
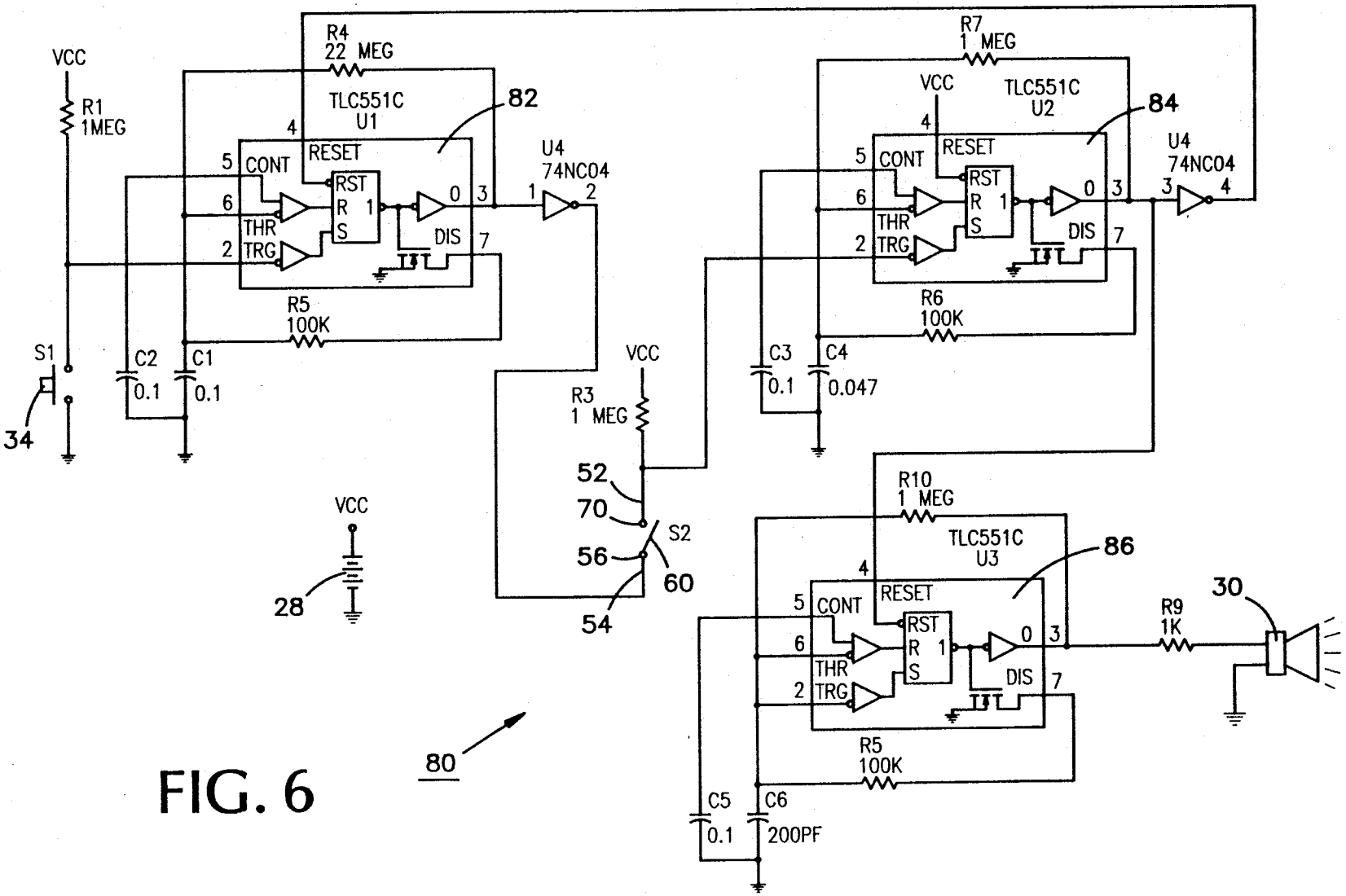
FIG. 6 is a schematic diagram of the circuitry of the device of FIG. 1.

Operation of device 20 will now be described with reference to FIG. 6 whereon there is shown circuitry, generally indicated by the reference numeral 80, which may be disposed on circuit board 26 (FIG. 2). To initiate operation of device 20, reset button 34 is momentarily depressed. This activates arming circuit 82 which arms device 20 for a selected period of time, say, 20 seconds. If, during that period of time, the circuit between leads 52 and 54 is closed, timing circuit 82 will cause oscillator circuit 84 to emit a short (say, 0.5 second) beep on speaker 30.

Golfer 10 calibrates device 2 by assuming a correct stance with his head plumb and his eyes directed toward golfball 12 (FIG. 1). He then presses reset button 34 and rotates knob 42 so that only a slight rotational movement of his head toward the direction the golfball is to travel will produce a beep. Now, when golfer 10 is preparing to hit golfball 12, he again presses reset button 34. Sounding of the beep before golfball 12 is struck by club 14 will indicate that golfer 10 is improperly moving his head prematurely.

In effect, device 20 is a biofeedback device and continued practice with the device will permit golfer 10 to coordinate his arm and head movements. Device 20 is conveniently placed on golfer 10's ear and, because of the configuration of the device, it can be positioned in nearly precisely the same position each time it is used. Device 20 is armed for only a relatively brief period and then automatically disarms without the golfer having to take any further action.

To accommodate left-handed golfers, sensor 24 may be arranged with contact tab 70 on the opposite side of housing 50.

The materials of construction of device 20 may be any suitable known materials and contact wire 60, ball 62, base 56, and contact tab 70 are preferably gold-plated to protect them in an outdoors environment. Housing 22 may be economically constructed of injection molded polymeric materials by conventional methods.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A device for indicating rotation of the head of a golfer during the process of hitting a golfball, comprising:

(a) a housing;

(b) sensor means disposed in said housing to sense the beginning of angular unidirectional rotation of said head from an initial position, generally about the axis of the spine of said golfer, and to produce an output signal thereupon;

(c) sound producing means activatable in response to said output signal to provide an audible signal to said golfer;

(d) adjusting means to adjust said sensor means so that said sensor means will not produce said output singal when said head is in a desired position, but will produce said output signal when said head begins to rotate in the direction said golfball will be hit;

(e) manual switch means to activate energizing means to which said sensor means is responsive to permit said sensor means to produce said output signal only during a selected period of time only after each closing of aid manual switch means; and (f) said sensor means including a pendulum switch to close upon said angular unidirectional rotation of said head of said golfer.

2. A device, as defined in claim 1, wherein said housing is adapted to be supported by the ear of said golfer.

3. A device, as defined in claim 2, wherein said manually initiated energizing means can be manually initiated while said housing is supported by said ear.

4. A device, as defined in claim 1, wherein said sensing means includes:

(a) an electrically conductive base member disposed in said housing;

(b) an elongate, relatively rigid, conductive member loosely disposed through said base member;

(c) means to maintain said base member and said elongate member in relative constant vertical relationship;

(d) a weight fixedly attached to the lower portion of said elongate member below said base member to maintain said elongate member in vertical position relative to the earth;

(e) an electrical contact adjustably fixedly disposed within said housing and closely disposed near the upper portion of said elongate member, such that rotational movement of said housing in one direction with respect to said elongate member will cause said electrical contact and said upper portion to engage;

(f) first and second electrical leads attached to said base member and to said electrical contact; and (g) electrical circuitry attached to said electrical leads to detect when said electrical contact and said upper portion engage and to provide said output signal in response thereto.

5. A device, as defined in claim 4, wherein said housing is adapted to be removably supported by the ear of said golfer.

6. A device, as defined in claim 5, further comprising said adjusting means is operatively connected to said base member and extends through said housing such that said golfer can adjust the orientation of said base member while said housing is supported by said ear.

7. A device, as defined in claim 1, wherein said audible signal is a "beep".

8. A method for indicating rotation of the head of a golfer during the process of hitting a golfball, comprising:

(a) sensing the beginning of angular unidirectional rotation of said head from an initial position, generally about the axis of the spine of said golfer, and producing an output signal thereupon;

(c) producing a sound n response to said output signal to provide an audible signal to said golfer;

(d) providing adjusting means to adjust said sensor means so that said sensor means will to produce said output signal when id head is in a desired position, but will produce said output signal when said head beings to rotate in the direction said golfball will be hit;

(e) closing manual switch means to activate energizing means to which said sensor means is responsive to permit said sensor means to produce said output signal only during a selected period of time only after each closing of said manual switch means; and (f) said sensor means including a pendulum switch to close upon said angular unidirectional rotation of said head of said golfer.

* * * * *

UNITED STATES PATENT AND TRADEMARK OFFICE

CERTIFICATE OF CORRECTION

PATENT NO. : 5,251,902

DATED : 10/12/93

INVENTOR(S) : John Federowics et al.

It is certified that error appears in the above-indentified patent and that said Letters Patent is hereby corrected as shown below:

In column 3, line 40, "2" should be ---20---.

In column 4, line 38, "aid" should be ---said---.

In column 6, line 3, "n" should be ---in---.

In column 6, line 6, "to" should be ---not---.

Signed and Sealed this

Twenty-second Day of March, 1994

*Attest:*

Bruce Lehman

BRUCE LEHMAN

*Attesting Officer*

*Commissioner of Patents and Trademarks*